US010086637B2

(12) United States Patent
Harris et al.

(10) Patent No.: US 10,086,637 B2
(45) Date of Patent: Oct. 2, 2018

(54) DEVICE WITH QUICK-ATTACH FEATURE

(71) Applicant: ACCO Brands Corporation, Lake Zurich, IL (US)

(72) Inventors: Richard H. Harris, Xenia, OH (US); Noah E. Dingler, Phoenixville, PA (US); Patrick B. Nolan, Royersford, PA (US); Michael A. Dotsey, Chester Springs, PA (US); Andrew J. Miller, Exton, PA (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 567 days.

(21) Appl. No.: 14/458,793

(22) Filed: Aug. 13, 2014

(65) Prior Publication Data

US 2015/0048610 A1 Feb. 19, 2015

Related U.S. Application Data

(60) Provisional application No. 61/865,250, filed on Aug. 13, 2013.

(51) Int. Cl.

| | |
|---|---|
| ***B42F 3/00*** | (2006.01) |
| ***B42D 1/00*** | (2006.01) |
| ***B42D 3/12*** | (2006.01) |
| ***B42F 7/02*** | (2006.01) |
| ***B42F 7/06*** | (2006.01) |
| ***B42F 11/00*** | (2006.01) |
| ***B42F 13/40*** | (2006.01) |

(52) U.S. Cl.

CPC ..... *B42D 1/007* (2013.01); *B42D 3/12* (2013.01); *B42F 3/003* (2013.01); *B42F 3/006* (2013.01); *B42F 7/02* (2013.01); *B42F 7/06* (2013.01); *B42F 11/00* (2013.01); *B42F 13/40* (2013.01)

(58) Field of Classification Search

CPC ..... B42F 3/003; B42F 3/006
USPC ..... 402/79; 229/67.1
See application file for complete search history.

(56) References Cited

U.S. PATENT DOCUMENTS 717,957 A * 1/1903 Weaver ..... B42F 13/12 402/79
1,443,092 A * 1/1923 Pettis ..... B42F 3/003 402/79

(Continued)

FOREIGN PATENT DOCUMENTS

DE 29722164 U1 * 2/1998 ..... B42F 3/003
EP 0354768 9/1994

(Continued)

OTHER PUBLICATIONS

PCT, International Search Report and Written Opinion, International Application No. US/2014/050905 (dated Nov. 25, 2014).

*Primary Examiner* — Kyle R Grabowski
(74) *Attorney, Agent, or Firm* — Thompson Hine LLP

(57) ABSTRACT

A system including a panel having a panel opening and a coupling device coupled to the panel. The coupling device includes a coupling device opening and a flange positioned adjacent to the coupling device opening. The coupling device opening at least partially overlaps with the panel opening, and the flange is elastically deflectable to allow a binding mechanism to pass the flange and into or out of the coupling device opening.

34 Claims, 20 Drawing Sheets

(56) References Cited

U.S. PATENT DOCUMENTS 3,107,673 A * 10/1963 Haddad ..... B42F 3/00 402/79
4,193,704 A 3/1980 Miller et al.
4,430,015 A 2/1984 Nerlinger
5,417,509 A * 5/1995 Schwartz ..... B42F 11/00 281/31
5,524,998 A * 6/1996 Schwartz ..... B42D 13/00 402/79
5,590,972 A * 1/1997 Shobin ..... B42F 3/006 281/21.1
D404,424 S 1/1999 Covey
6,086,281 A 7/2000 Covey
D432,166 S * 10/2000 Matheson ..... D19/26
6,168,340 B1 * 1/2001 Lehmann ..... B42F 7/06 281/38
6,196,750 B1 3/2001 Hansen
D442,631 S 5/2001 Pfanner et al.
6,390,713 B1 5/2002 Moor et al.
6,729,790 B1 5/2004 Moor et al.
6,874,968 B2 * 4/2005 Schwartz ..... B42F 5/00 229/67.1
7,077,597 B2 * 7/2006 Davies ..... B26F 1/12 402/79
8,277,140 B2 10/2012 Chizmar
9,290,034 B2 3/2016 Busam et al.
2001/0022916 A1 * 9/2001 Moor ..... A45C 7/0068 402/79

FOREIGN PATENT DOCUMENTS

EP 0962335 A1 * 12/1999 ..... B42F 3/003
EP 0963860 A1 * 12/1999 ..... B42F 3/006
EP 1072439 A2 * 1/2001 ..... B42F 3/003
EP 0748703 3/2002
WO 2008/142573 11/2008

* cited by examiner

DEVICE WITH QUICK-ATTACH FEATURE

This application claims priority to U.S. Provisional Patent Application Ser. No. 61/865,250, filed on Aug. 13, 2013, the entire contents of which are hereby incorporated by reference.

BACKGROUND

School and office products, such as filers, dividers, notebooks, folders, portfolios, pockets, storage device and the like are often utilized to store papers and other loose items. In many cases, it is desired to secure the school and office product to a binding mechanism, such as a three ring binder/binding mechanism. However, many existing systems utilize closed holes which require the binding mechanism to be opened and closed to bind the school and office product to the binding mechanism.

SUMMARY

In one embodiment, the present invention is a device which can be quickly and easily attached to a binding mechanism, without having to open or close the binding mechanism. More particularly, in one embodiment the invention is a system including a panel having a panel opening and a coupling device coupled to the panel. The coupling device includes a coupling device opening and a flange positioned adjacent to the coupling device opening. The coupling device opening at least partially overlaps with the panel opening, and the flange is elastically deflectable to allow a binding mechanism to pass the flange and into or out of the coupling device opening.

DETAILED DESCRIPTION

Figure 1:
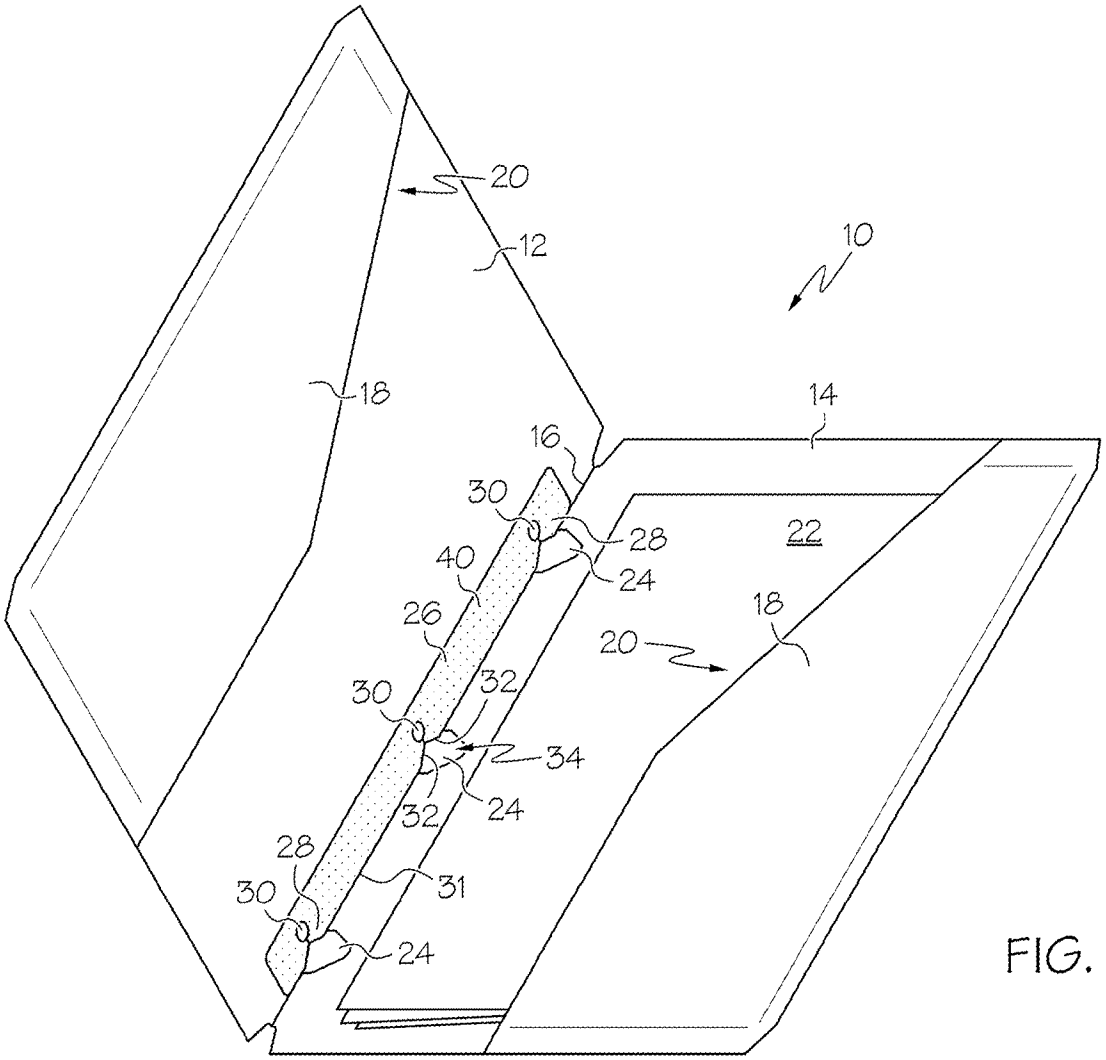
FIG. 1 is an upper perspective view of one embodiment of a storage device of the present invention, shown in a partially open configuration.

In one embodiment the present invention takes the form of a divider, pocket, folder, portfolio, binder, filer and/or storage device such as a folder pocket 10 as shown in FIGS. 1-5. In this embodiment, the pocket 10 includes a first main panel 12 and a second main panel 14 pivotally coupled together along a pivot line or fold line 16. Each of the main panels 12, 14 may include a pocket panel 18 positioned thereon defining a storage pocket 20 with the associated main panel 12, 14, wherein each storage pocket 20 can receive papers 22 (see FIG. 1) or other loose items therein.

Figure 2:
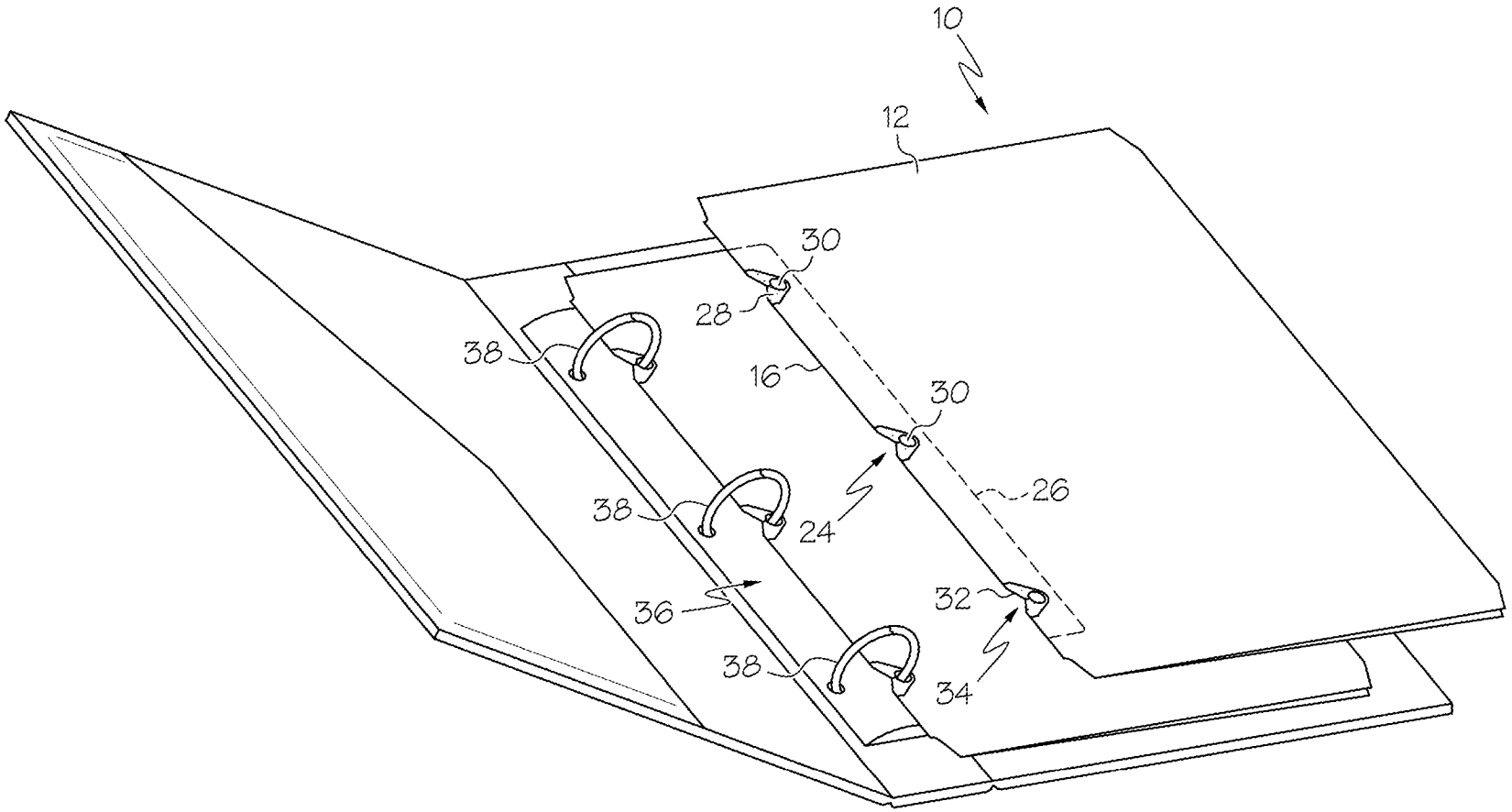
FIG. 2 is an upper perspective view of the storage device of FIG. 1, shown in its closed configuration, and positioned for coupling with a binder.
Figure 4:
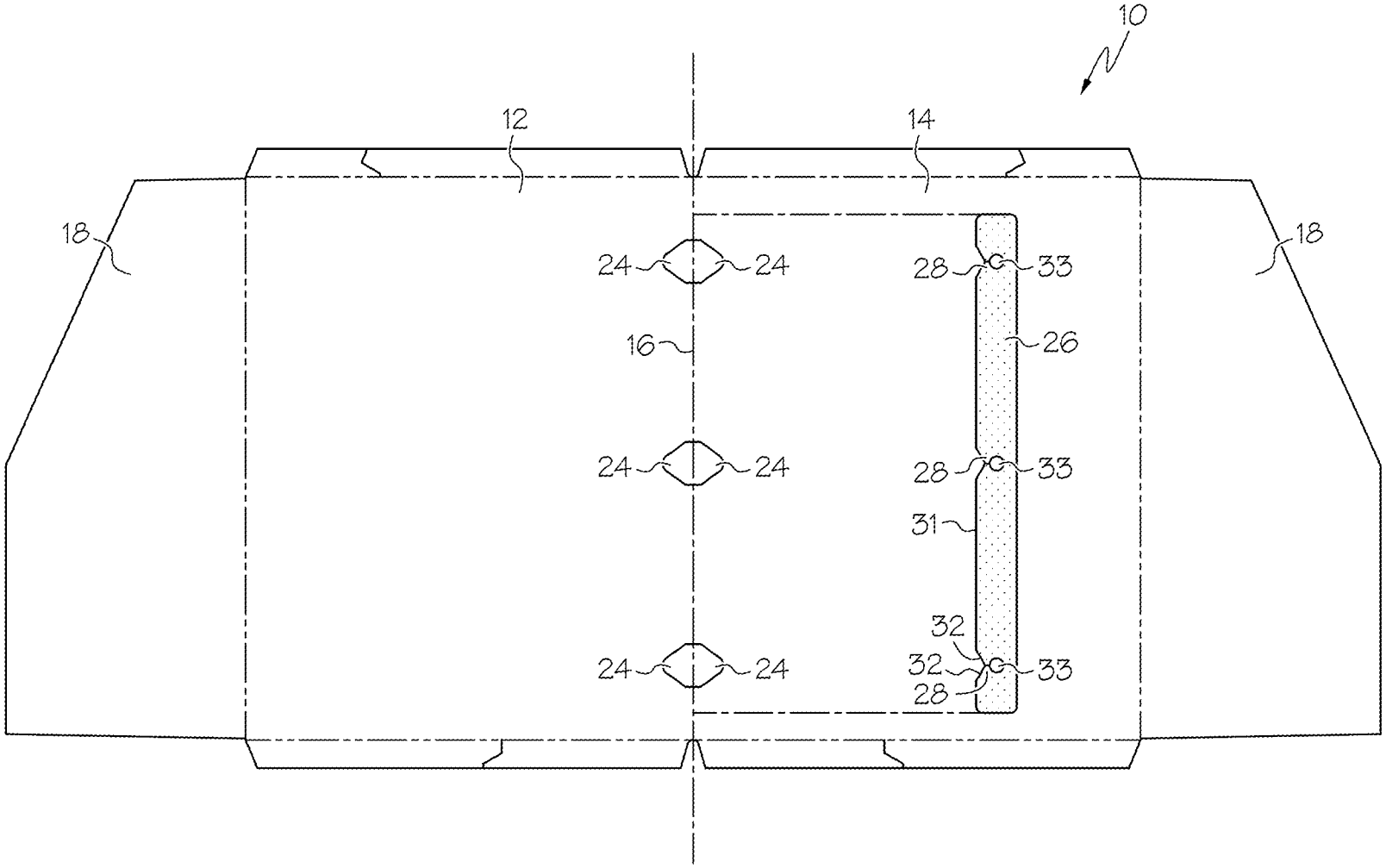
FIG. 4 is a top view of the storage device similar of FIGS. 1-3, shown in its unassembled configuration and with the coupling device exploded away.
Figure 5:
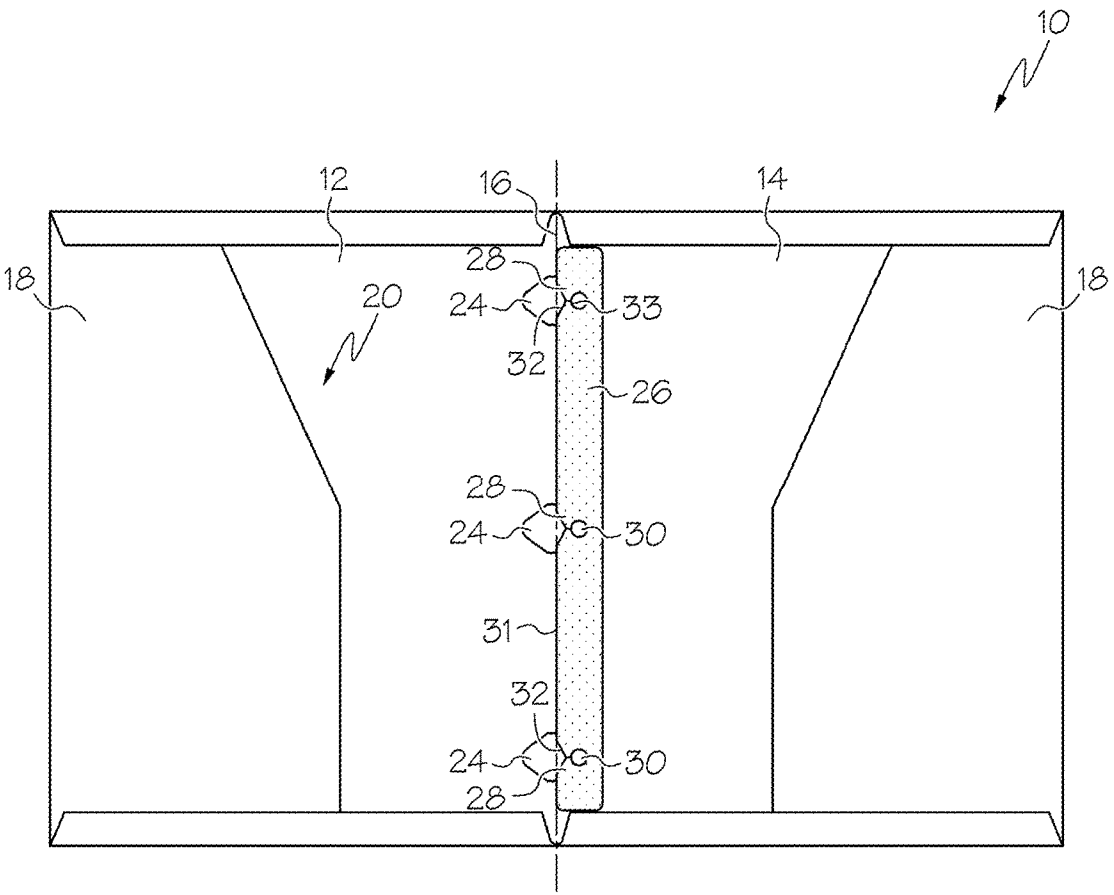
FIG. 5 is a top view of the storage device of FIG. 4, with the coupling device in place and the pocket panels folded in place.

In one embodiment the pocket 10 is moveable between an open (or fully open) configuration, wherein the first 12 and second 14 main panels are generally parallel, coplanar and adjacent each other in a non-overlapping configuration, and access to the storage pockets 20 is provided, and a closed configuration, wherein the main panels 12, 14 are generally parallel, non-coplanar and face each other in an overlapping configuration, generally blocking access to the storage pockets 20 (FIG. 2). In one embodiment the first main panel 12, second main panel 14 and/or pocket panels 18 are made from a single, unitary piece of material, as shown in FIGS. 4 and 5, although different pieces of material joined together can be used. The panels 12, 14, 18/pocket 10 may be made any of a wide variety of materials, including but not limited to polymers (including plastic), cardboard, paper, polymer coated paper or cardboard, fabric covered paper or cardboard, etc. Each panel 12, 14 may be sized to receive and/or cover various sheets of paper, such as 8.5 inch×11 inch paper, or A4 paper or the like, and thus may be sized larger than those papers.

Each of the first 12 and second 14 main panels may include one or more openings, cut-outs or notches 24 formed therein adjacent to, and/or intersecting, the fold line 16. Each notch 24 is generally triangular in the illustrated embodiment with a base of the triangle aligned with the fold line 16, but the notches 24 can take any of a wide variety of shapes. The notches 24 on the first 12 and second 14 main panels may be aligned and symmetrical with respect to the fold line 16. Each of the panels 12, 14 may include an outer perimeter, and the notch 24 can intersects or is located immediately adjacent to the outer perimeter to enable coupling/decoupling access, as described in greater detail below.

A coupling device 26 can be secured to at least one of the main panels 12, 14 (the left main panel 12 in the embodiment of FIG. 1 and the right main panel 14 in the embodiment of FIG. 5). The illustrated coupling device 26 takes the form of a generally rectangular component including three pairs of flanges or flaps 28 spaced therealong. Each flange 28 pair is aligned with and at least partially positioned in one of the notches 24. Each flange 28 pair may define an opening 30 therebetween and/or be positioned adjacent an opening 30, wherein the flanges 28 in a flange pair are positioned on opposite sides of the associated opening 30. In the illustrated embodiment the openings 30 are generally circular, although the openings 30 can have other shapes if desired. Each opening 30 can be aligned with/overlapping with an associated notch 24.

Each flange 28 can have an angled surface or guide surface 32 at an outer end thereof (an end opposite the opening 30), wherein the angled surfaces 32 are configured such that they converge in a direction approaching the central opening 30 (forming a generally "V" shape, with a vertex in one case) and/or are angled (i.e. a non-parallel and non-perpendicular angle) away from the fold line 16 and/or the outer surface/edge of the coupling device 26. In this manner, each angled surface 32 forms an angle (i.e. a non-parallel and non-perpendicular angle) with an outer edge 31 of the coupling device 26. Each angled surface 32 can be angled toward the associated opening 30 such that, in one case, a line defined by the angled surface 32 intersects the opening 30, or, if it does not actually intersect the opening 30, passes within one diameter or radius of the opening 30 of actually intersecting the opening 30. If desired the "angled surfaces" 32 can also be curved or the like.

The coupling device 26/flanges 28 can be made of the same or similar materials as outlined above for the pocket 10. One or both of the flanges 28 can be made of a relatively pliable and/or elastically-deflectable material (i.e. wherein, in one case, the flanges 28 can be bent or deflected when external forces are applied but return to their original shape when the external forces are removed), for purposes of which are described below. The coupling device 26/flanges 28 can be utilized to quickly and easily couple or decouple the pocket 10 to a binder/binding mechanism 36, such as a three ring binder/binding mechanism 36 shown in FIG. 2, having a set of binding rings 38.

Figure 3A:
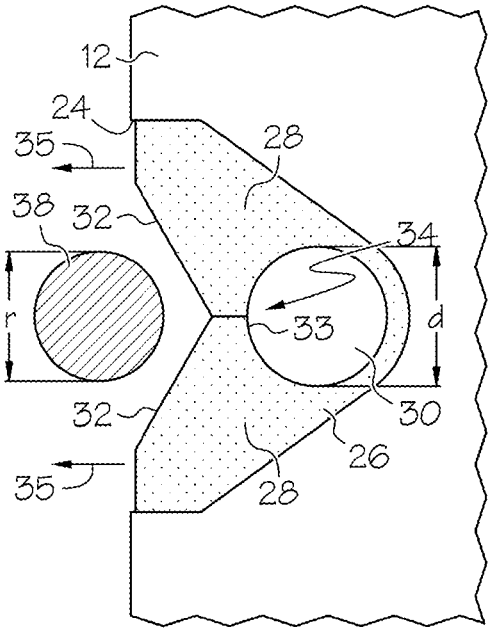
FIGS. 3A, 3B, and 3C are a sequence of detail views illustrating the storage device of FIGS. 1 and 2 being coupled to the binder of FIG. 2.
Figure 3B:
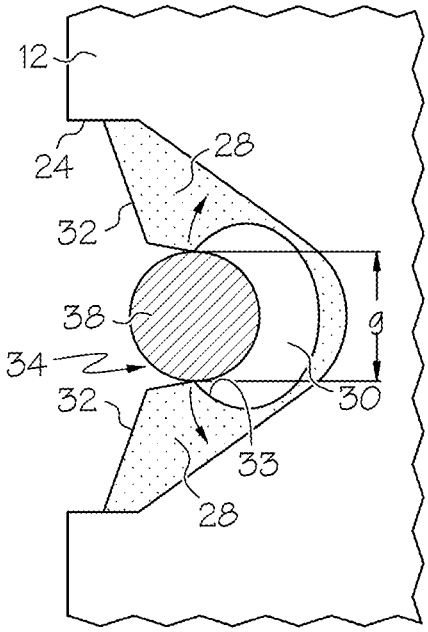
Figure 3C:
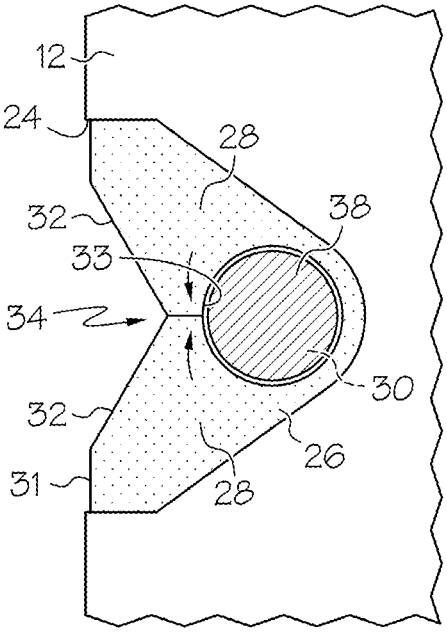

With reference to FIG. 3A, in order to couple the pocket 10 to a ring 38 of a binding mechanism 36, the pocket 10 is positioned such that a ring 38 is positioned between a pair of flanges 28. The pocket 10 is then urged towards the ring 38 (as shown by arrows 35), causing the ring 38 to engage the angled surfaces 32 of the flanges 28. The shape of the flanges 28, the nature of the applied forces and the material of the flanges 28 cause the flanges 28 to move apart from each other, as by FIG. 3B, thereby forming or enlarging a gap 34 between the flanges 28 until the gap 34 is sufficiently large to allow the ring 38 to pass between/through the flanges 28 and be fully seated in the opening 30. In one case, with reference to FIG. 3A, a diameter/size d of the opening 30 along the direction of the fold line 16/outer edge may about equal to or greater than the width r of the binder ring 38 to allow the binder ring 38 to be positioned in the opening 30 without applying any stress/deformation (or only applying low stress/deformation) to the flanges 28/coupling device 26, as shown in FIG. 3C.

The process can then be repeated for the other flange 28 pairs/rings 38, or all flange 28 pairs can be simultaneously coupled to the associated rings 38. The pocket 10 can thus be easily bound/coupled to the binding mechanism 36 via the coupling device 26 by engagement of the flanges 28 with the rings 38.

Once the pocket 10 is bound to the binding mechanism 36, the pocket 10 can be pivoted about the rings 38 in a manner of a typical device or sheet of paper bound thereto. The pocket 10 may be able to be easily decoupled from the binding mechanism 36 by applying a retraction force normal to the axis of the binding mechanism 36 (e.g. in a direction opposite to arrow 35 of FIG. 3A). When a sufficient retraction force is applied, the rings 38 engage the curved/angled radially inner surface 33 of the flanges 28, urging the flanges 28 apart such that the binding rings 38 can be extracted from the openings 30. In this manner the inner surface 33 of the flanges guides the binding rings 38 toward the gap 34 between the flanges 28, in much the same manner as the angled surfaces 32 described above.

The illustrated pocket 10 includes three flange pairs 28 that are attachable to three rings 38; however, the number flange pairs 28 and rings 38 can vary. For example, in one case the pocket 10 includes two flange pairs 28 that are attachable to two rings 38, or various other combinations including at least one flange pair 28 and one ring or coupling device 38.

In the embodiment of FIGS. 1-3, the coupling device 26 includes a body or spine 40 extending generally longitudinally, parallel to the fold line 16, with three sets of flange 28 pairs coupled thereto. However, it should be understood that the coupling device 26 may lack the spine 40, and may instead take the form of three (or more or less, as desired) discrete, spaced apart flange 28 pairs which are coupled to the pocket 10. However, the use of the body 40 can be useful to provide easier alignment and attachment of multiple flange 28 pairs.

As noted above, in the illustrated embodiment the coupling device 26 is made of a separate piece of material which is secured to the associated main panel 12. In this case the coupling device 26 can be secured to the pocket 10 by any of a wide variety of means and mechanisms, such as adhesives, heat staking, welding, inter-engaging geometries, staples or other mechanical joining devices, etc. However, it should be understood that the coupling device 26 can be made of the same material as the panels 12, 14 and/or 18 of the pocket 10 and may, in fact, be integrally formed, and formed from the same piece of material, as the panels 12, 14 and/or 18. In this case the coupling device 26 may include only those portions of the flanges 28 that protrude into the notches 24 and/or at least partially define the opening 30.

In addition, the embodiment of FIGS. 1-5 shows all flange 28 pairs positioned on one of the main panels 12, 14. However, differing ones of the flange 28 pairs can be positioned on differing ones of the main panels 12, 14. Moreover, flange 28 pairs can be positioned on both main panels 12, 14 even for the same associated notches 24, to provide more secure coupling. Finally, if desired one flange 28 of a flange pair can be positioned on one main panel 12, 14, and the other flange 28 of the flange pair can be positioned on the other main panel 12, 14. In this case, when the pocket 10 is in its closed position, as in FIG. 2, the flanges 28 can still cooperate to provide the releasable mounting arrangement described above.

As can be seen, the pocket 10 may include a set of three notches 24 on each main panel 14, 16 and three flange 28 pairs can be provided on the pocket 10 and configured to align with the notches 24 and the three rings 38 of the binding mechanism 36 to enable releasable attachment to the binding mechanism 36. However, the notches 24/coupling device 26 can be configured to secure the pocket 10 to other binding mechanisms or devices, in which case the notches 24/coupling device 26 can be configured as desired to match the corresponding binding mechanism. For example, in one embodiment, the pocket 10 includes a relatively large number of notches 24/flange 28 pairs such that the pocket 10 can be bound to a wire binding mechanism, such as a twin-wire or spiral-bound mechanism. In yet another embodiment, the pocket 10 can include two notches 24/flange 28 pairs to mount to two-ring binders.

In addition, it should be understood that the number of flange 28 sets may not necessarily correspond to the number of coils/turns/binding rings 38. For example, in the embodiments of FIGS. 1-5, if desired, only one set of flanges 28 may be utilized to secure the pocket 10 to the binding mechanism 36. In this case other structure, such as through-holes in the pocket 10, may be provided, if at all, at the positions of the other rings 38 to enable coupling of the pocket 10.

The coupling device 26 may be designed such that each flange 28 is equally flexible or deflectable. In some cases, however, one flange 38 is more flexible than the other, and in one case in particular only one of the flanges 28 has sufficient flexibility to be deflected during coupling/decoupling. In addition, although FIGS. 1-5 show the flanges 28 as having generally the same size and shape, and formed as mirror images, in some cases the flanges 28 in a flange 28 pair may be shaped, size or arranged differently. Further alternately, in one case only a single flange 28 is associated with each opening 30.

In the illustrated embodiment, the flanges 28 have no gap 34 therebetween when in the rest position, or the gap 34 is quite small. In other embodiments the gap 34 may be larger than that shown for ease of coupling, although in order to provide a relatively secure coupling, the size g of the gap (along a direction of the fold line 16 or associated outer edge of the pocket 10, see FIG. 3) may be less than the width r of the ring 38 extending in the same direction. Conversely, a diameter/size of the opening 30 along the direction of the fold line 16/outer edge may be greater than the size g of the gap 34.

Figure 7:
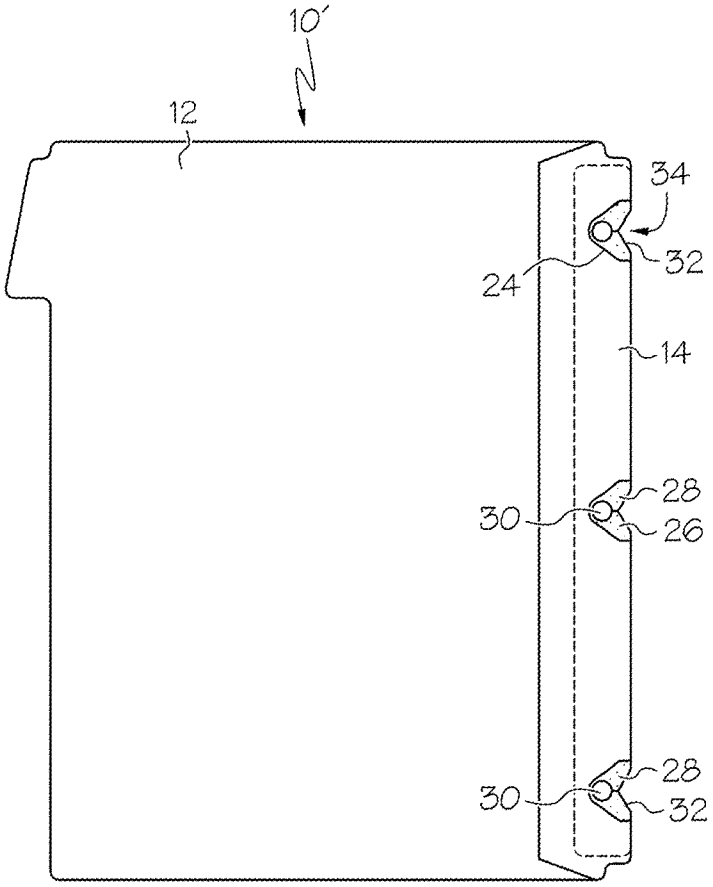
FIG. 7 is a top view of the device of FIG. 6 shown in its assembled configuration.
Figure 6:
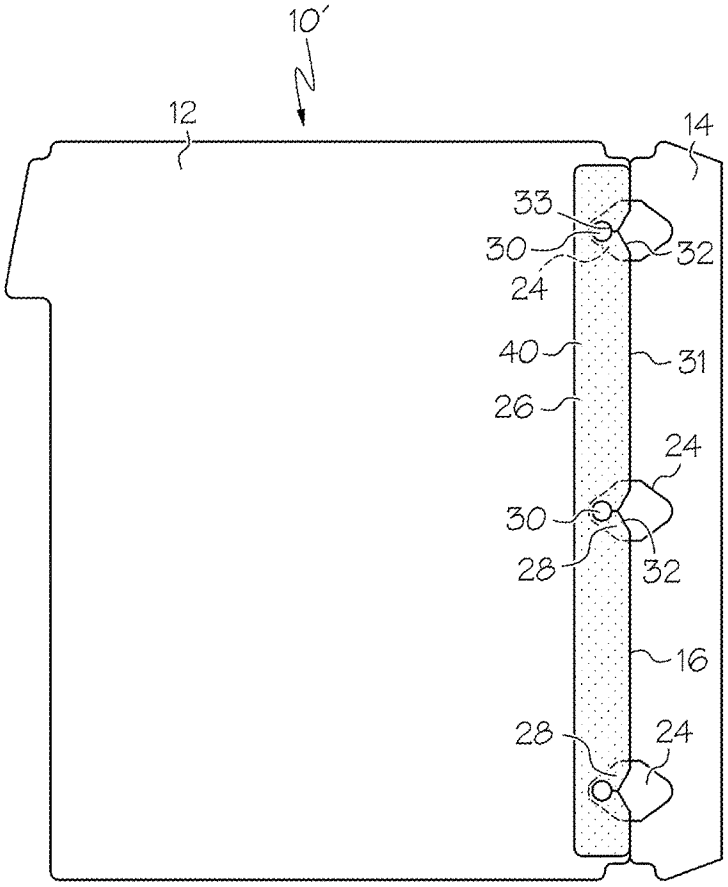
FIG. 6 is a top view of a divider, shown with a coupling device in place and in its unassembled configuration.

FIGS. 6 and 7 illustrate an alternate embodiment similar to the embodiment of FIGS. 1-5, but in this case the second main panel 14 is relatively short, in the lateral direction, compared to the first main panel 12, and is folded over and secured to the first main panel 12 and/or coupling device 26 (see FIG. 7). As shown in FIG. 7, the coupling device 26 can be positioned between the first 12 and second 14 panels. In this embodiment, then, the device 10' may be utilized as a divider that can be releasably coupled to a binding mechanism 36 in the same or similar manner as the pocket 10 shown in FIGS. 1-5 and described above.

Figure 8:
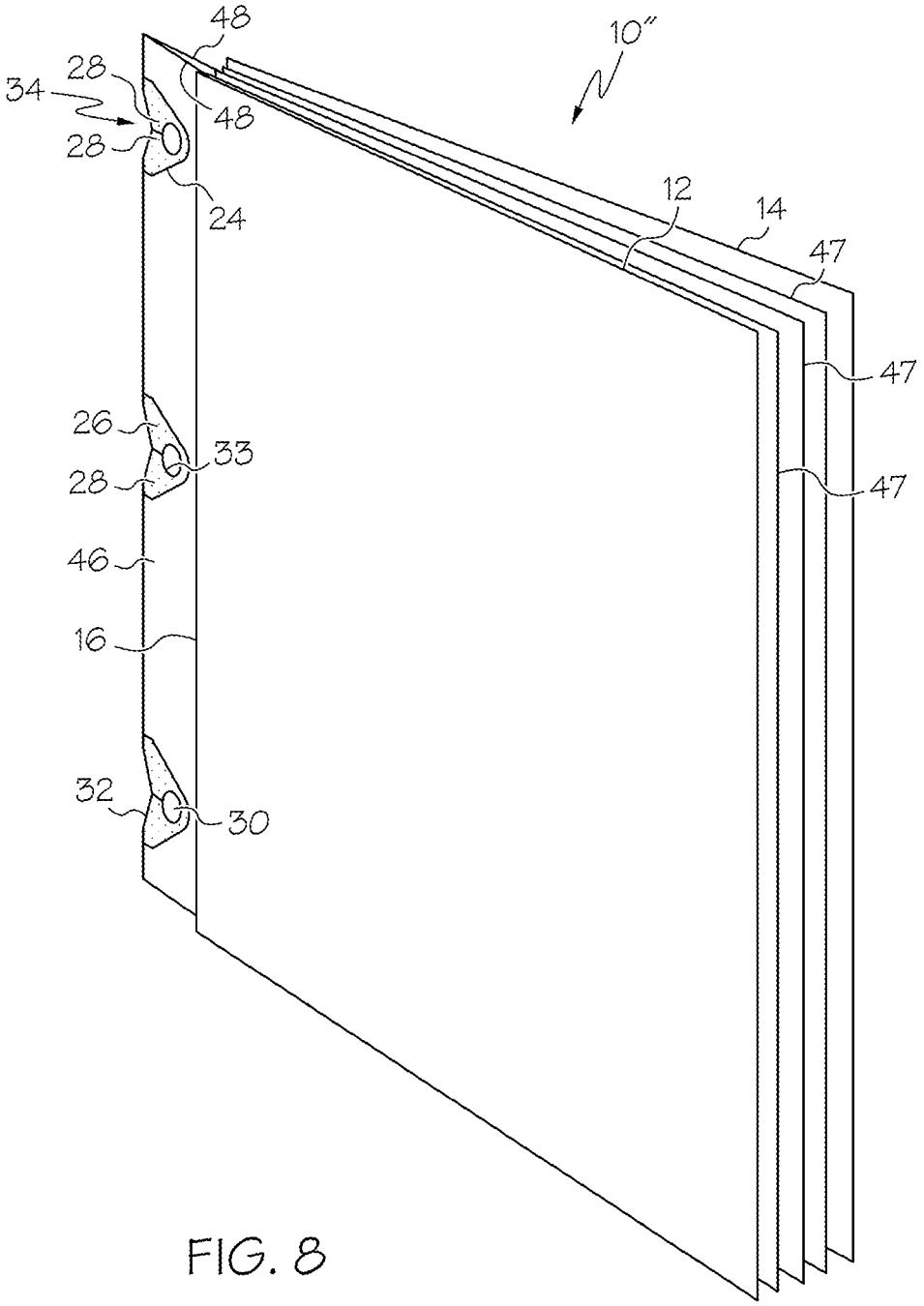
FIG. 8 is a front perspective view of another embodiment of a storage device.
Figure 9:
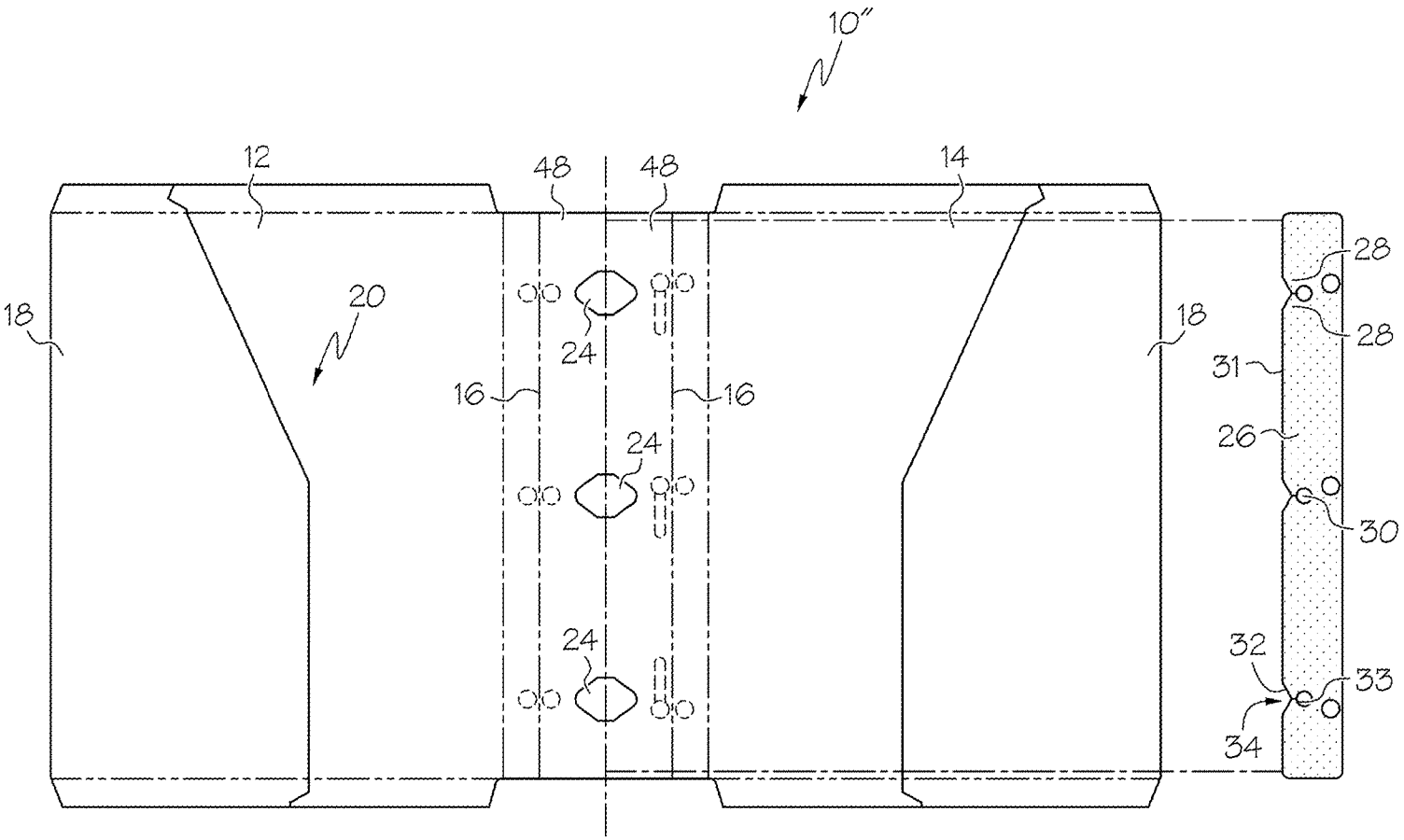
FIG. 9 is a top view of the storage device similar to the embodiment of FIG. 8, shown in its unassembled configuration and with the coupling device exploded away.
Figure 10:
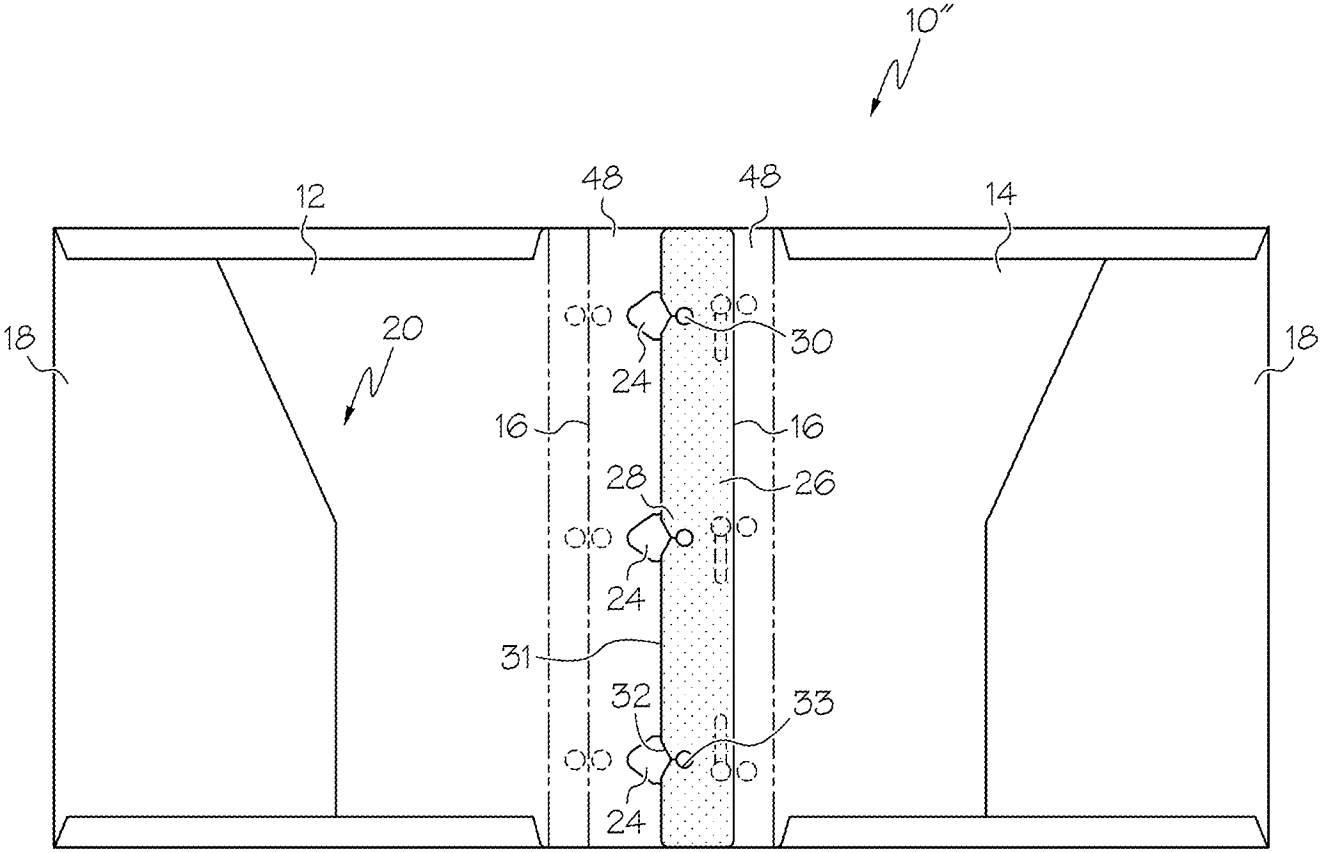
FIG. 10 is a top view of the storage device of FIG. 9, with the coupling device in place and the pocket panels folded in place.

FIGS. 8-10 illustrate an embodiment somewhat similar to that of FIGS. 1-5. However, in the device 10" of FIGS. 8-10 the first 12 and second 14 main panels are coupled to the fold line 16, and the device 10" includes a generally flat, planar spine 46 extending generally outwardly from the fold line 16. The spine 46 can be formed by facially joining spine portions 48 of the first main panel 12 and the second main panel 14, which are shown in FIGS. 9 and 10. In this case, then, the spine 46 can be three-ply component, including two spine portions 48 with the coupling device 26 positioned therebetween.

The spine 46 can be pivotally attached to the fold line 16, and can be removably secured to a binding mechanism 36, such as a three ring binder or the like, via the flanges 28. Moreover, in this embodiment, the notches 24 are formed through the spine portions 48 of the first 12 and second 14 main panels. The embodiment of FIG. 8 illustrates multiple internal dividers/pocket panels 47 coupled to the spine 46, while FIGS. 9 and 10 illustrate a pocket 10" with only two main panels 12, 14, although the device 10" need not necessarily include any pockets. Further alternatively, rather than being formed from the spine portions 48, the spine 46 can be a separate piece of material joined to the main panels 14, 16.

Figure 11:
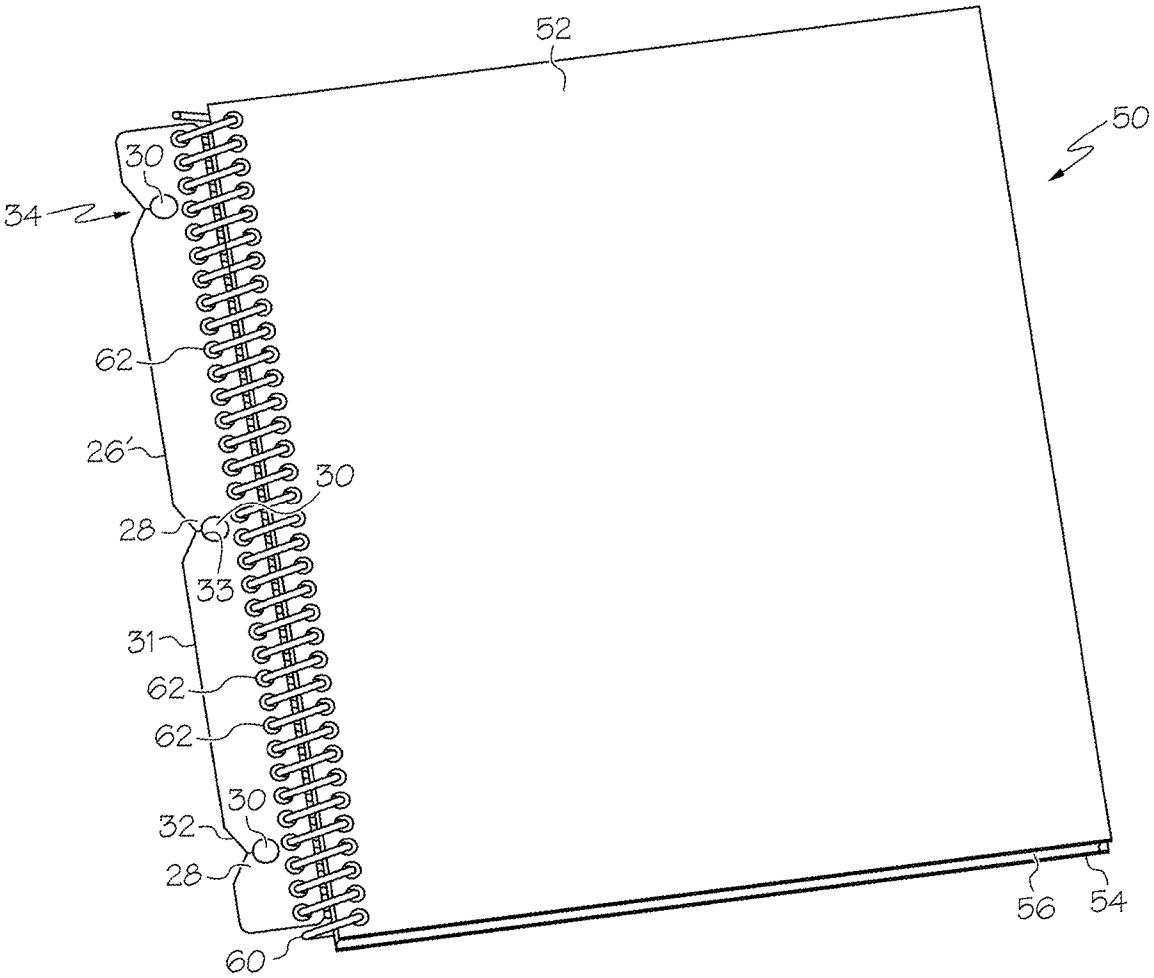
FIG. 11 is a top view of a bound component with a coupling device.

FIG. 11 illustrates another embodiment in the form of a notebook 50 which can include a front cover 52, a rear cover 54 and a plurality of pages 56, such as sheets of paper, bound together and positioned between the covers 52, 54. The illustrated notebook 50 includes a binding mechanism 60 binding the covers 52, 54 and sheets 56 together. In the illustrated embodiment, the binding mechanism 60 takes the form of a wire binding mechanism, such as a coil/spiral binding mechanism, a twin wire binding mechanism or the like.

In this embodiment the coupling device 26' takes the form of a generally elongated, rectangular component with a plurality of binding holes 62 extending along an inner edge thereof. Each binding hole 62 receives a turn/coil of the binding mechanism 60 to thereby bind the coupling device 26' to the notebook 50/binding mechanism 60. The coupling device 26' includes the sets of flanges 28 and openings 30 extending along an edge opposite the binding holes 62. The coupling device 26' can be used to thereby secure the notebook 50 to a three ring binder (or other binding mechanism) as desired. In the illustrated embodiment the coupling device 26' is permanently bound to the binding mechanism 60. In an alternative embodiment the binding holes 62 each include flanges 28 or the like so that the coupling device 26' can be removably coupled to the binding mechanism 60. In this manner the notebook 50 can be coupled to the wire binding mechanism 60, while being simultaneously releasably coupled to an entirely distinct and separate binding mechanism, such as a three binder.

Figure 12:
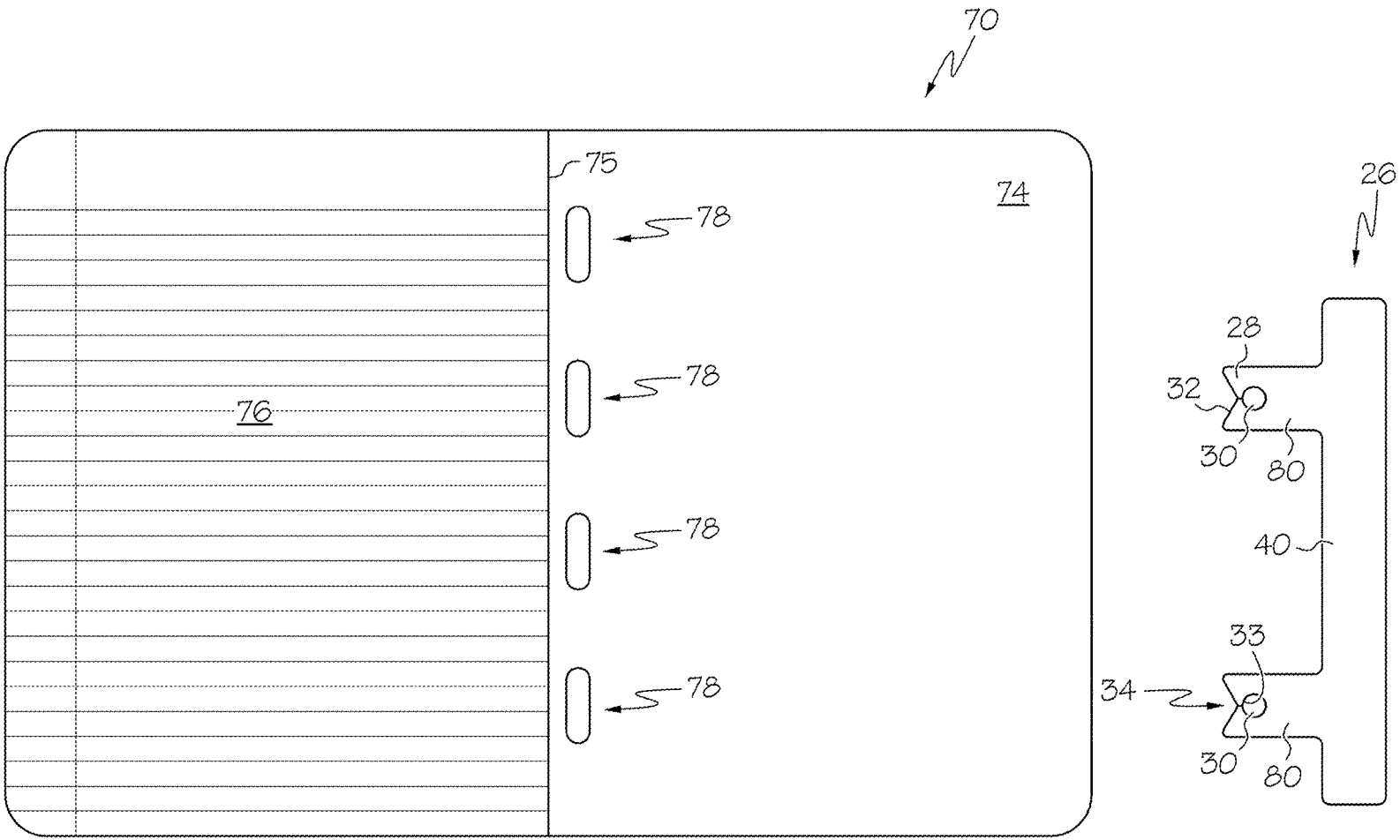
FIG. 12 is a top view of a bound component shown in combination with a coupling device.
Figure 13:
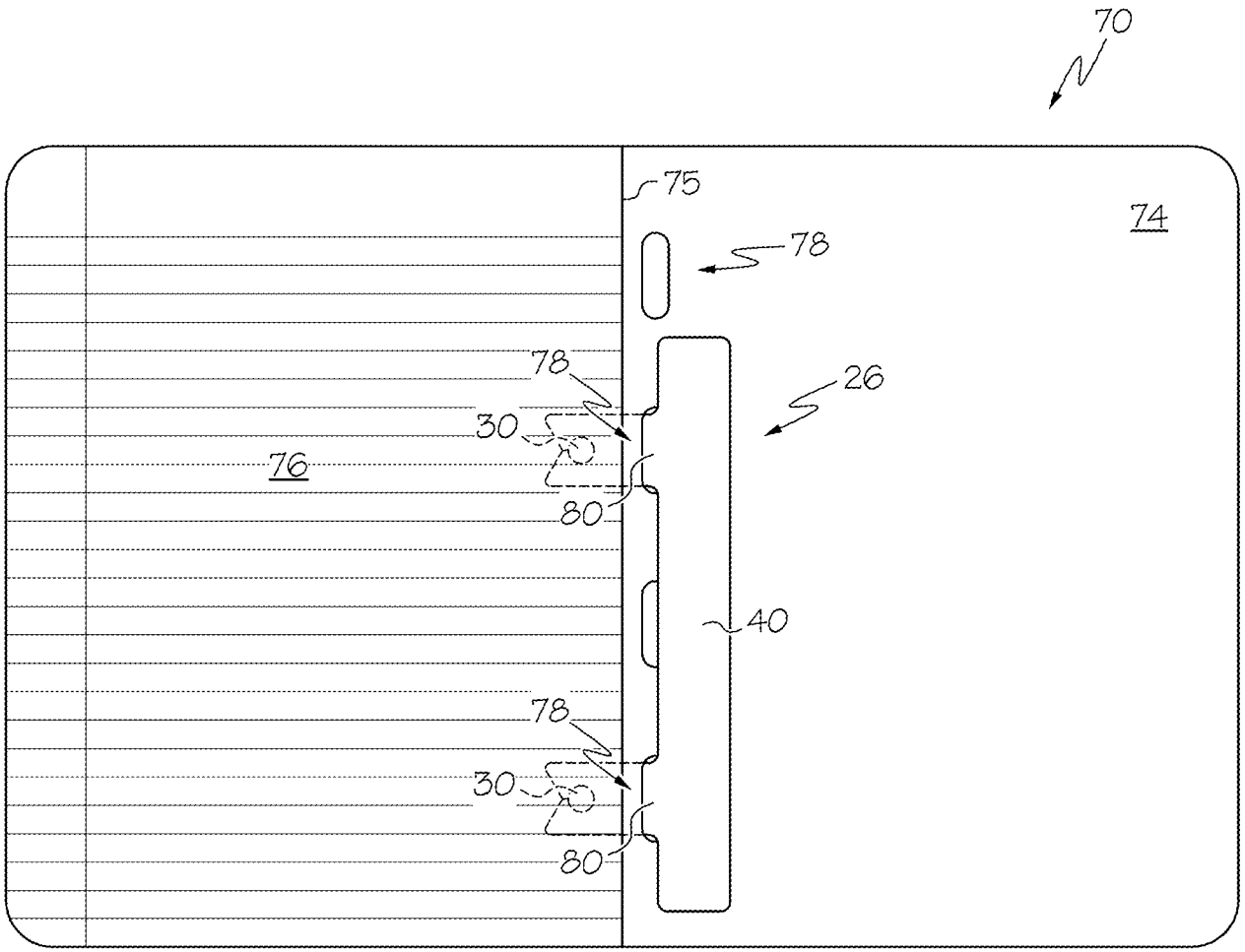
FIG. 13 is a top view of the coupling device of FIG. 12 inserted into/through the rear cover of the bound component of FIG. 12.
Figure 14:
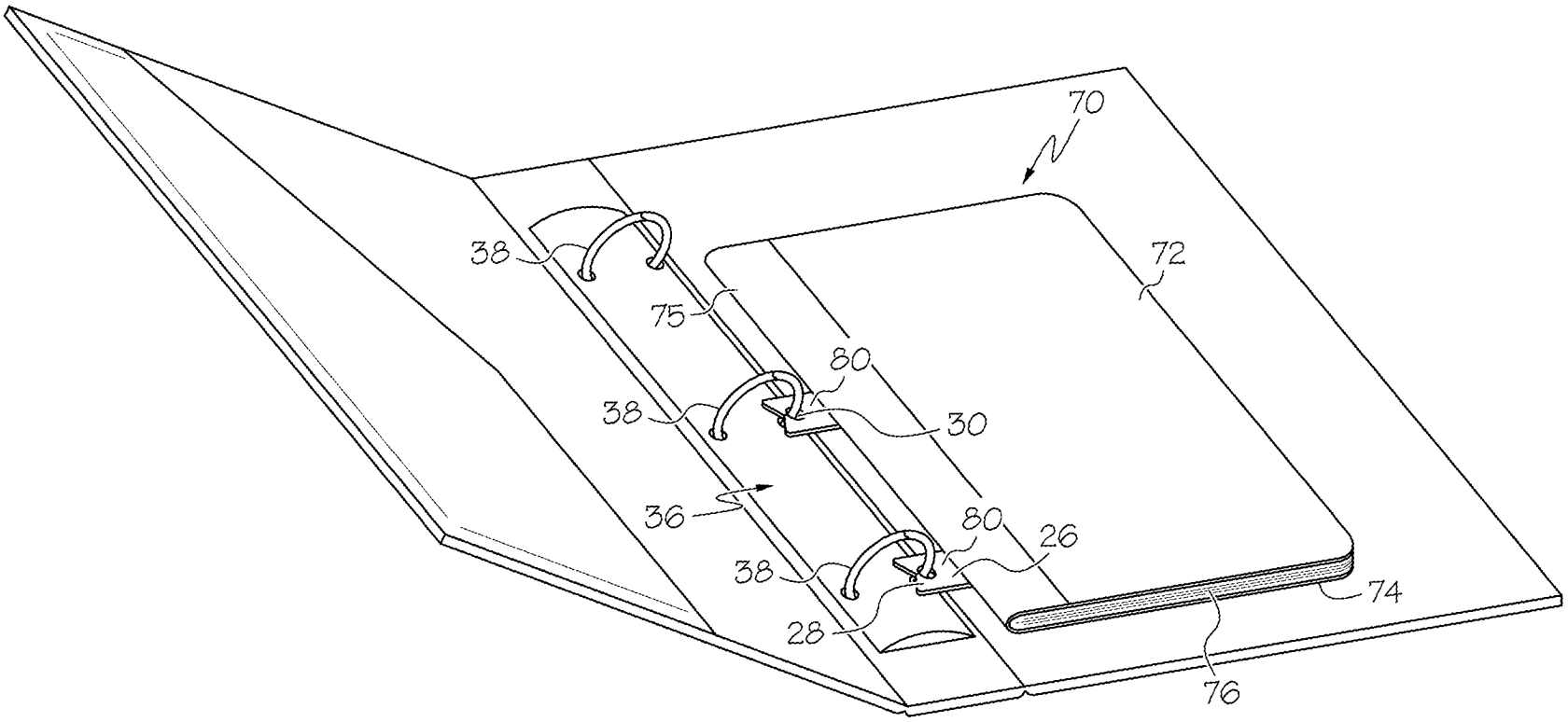
FIG. 14 illustrates the bound component of FIG. 13 bound to a binder via the coupling device.

FIGS. 12-14 illustrate another embodiment in which a bound device 70 such as a composition book or the like, has a front cover 72 and a rear cover 74, with a plurality of sheets of paper 76 bound therebetween. As shown in FIGS. 12 and 13, one of the covers (the rear cover 74, in the illustrated embodiment) includes a plurality of slots 78 formed therein, adjacent to the binding mechanism/spine 75 of the bound device 70 and extending parallel thereto. In this embodiment, the coupling device 26 includes a spine 40 with a pair of protrusions 80 extending generally perpendicular thereto, each protrusion 80 including a pair of flanges 28 as outlined above.

Each protrusion 80/flange 28 pair can be passed through one of the slots 78 of the cover 74 of the bound device 70, as shown in FIG. 13, such that the protrusions 80/flange 28 pairs extend therethrough. The coupling device 26 can then be utilized to releasably secure the bound device 70 to a binding mechanism 36, as shown in FIG. 14.

Figure 15:
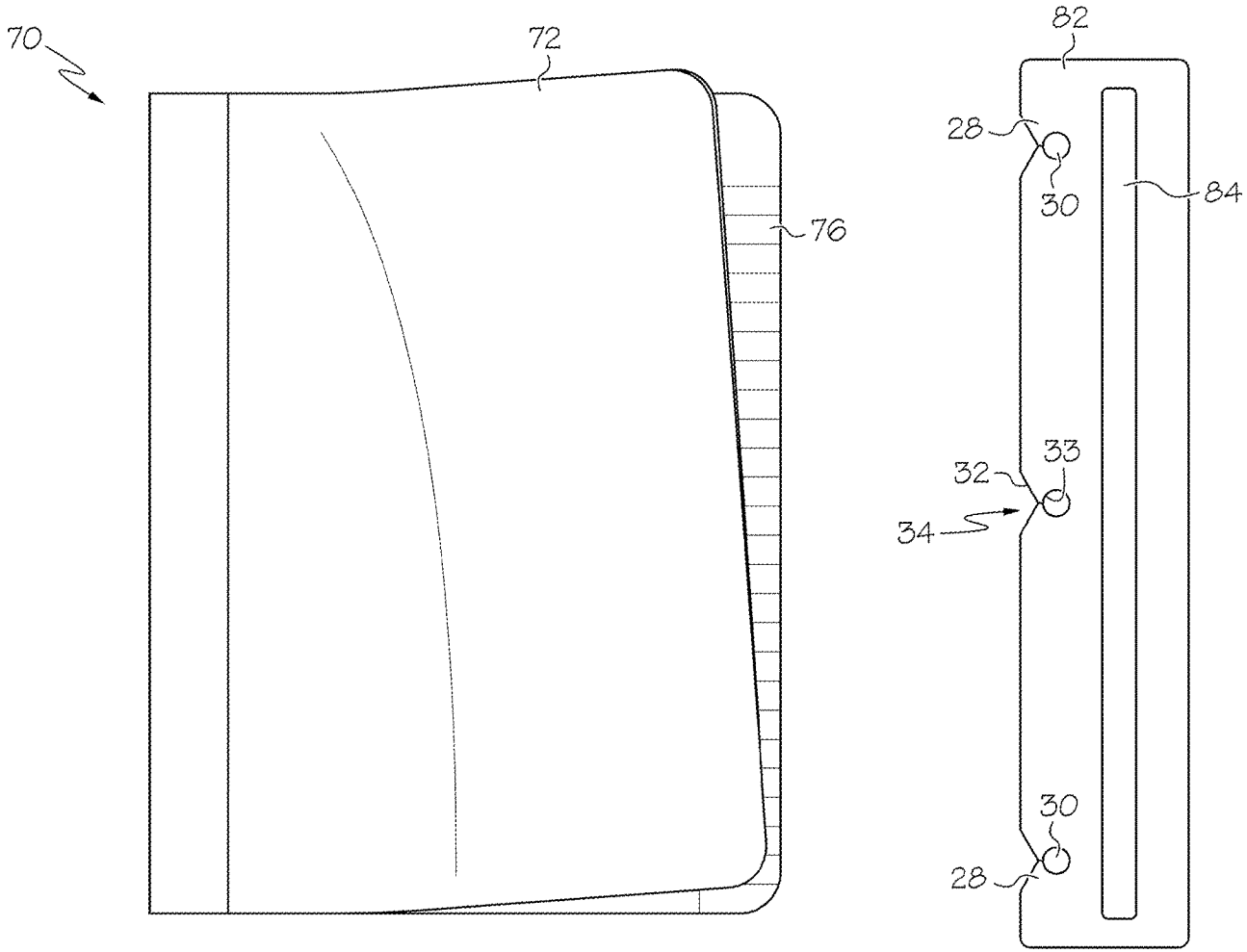
FIG. 15 is a top view of a bound component shown in combination with another coupling device.
Figure 16:
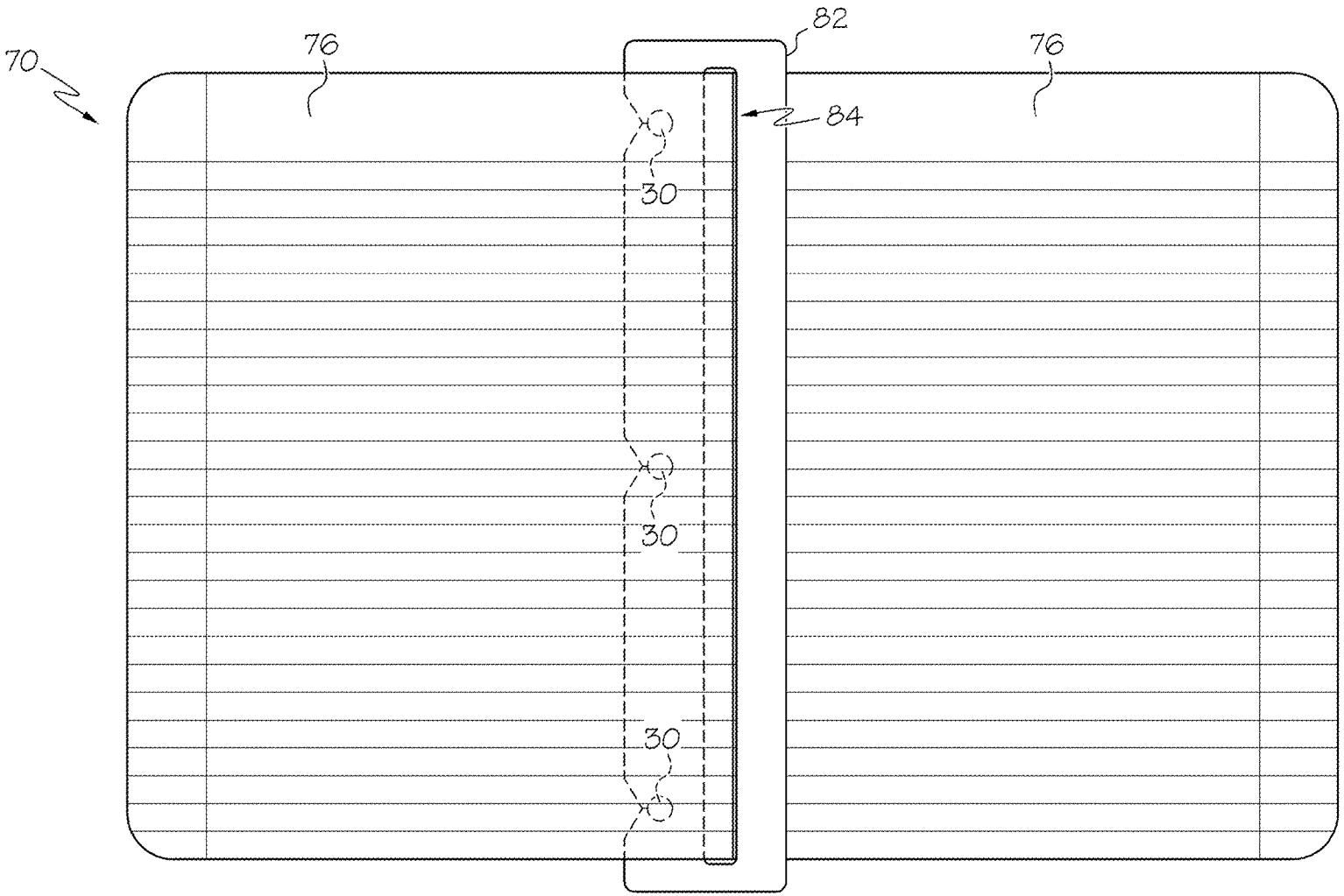
FIG. 16 is a top view of the bound component and coupling device of FIG. 15, shown coupled together and with the bound component in an open position.
Figure 17:
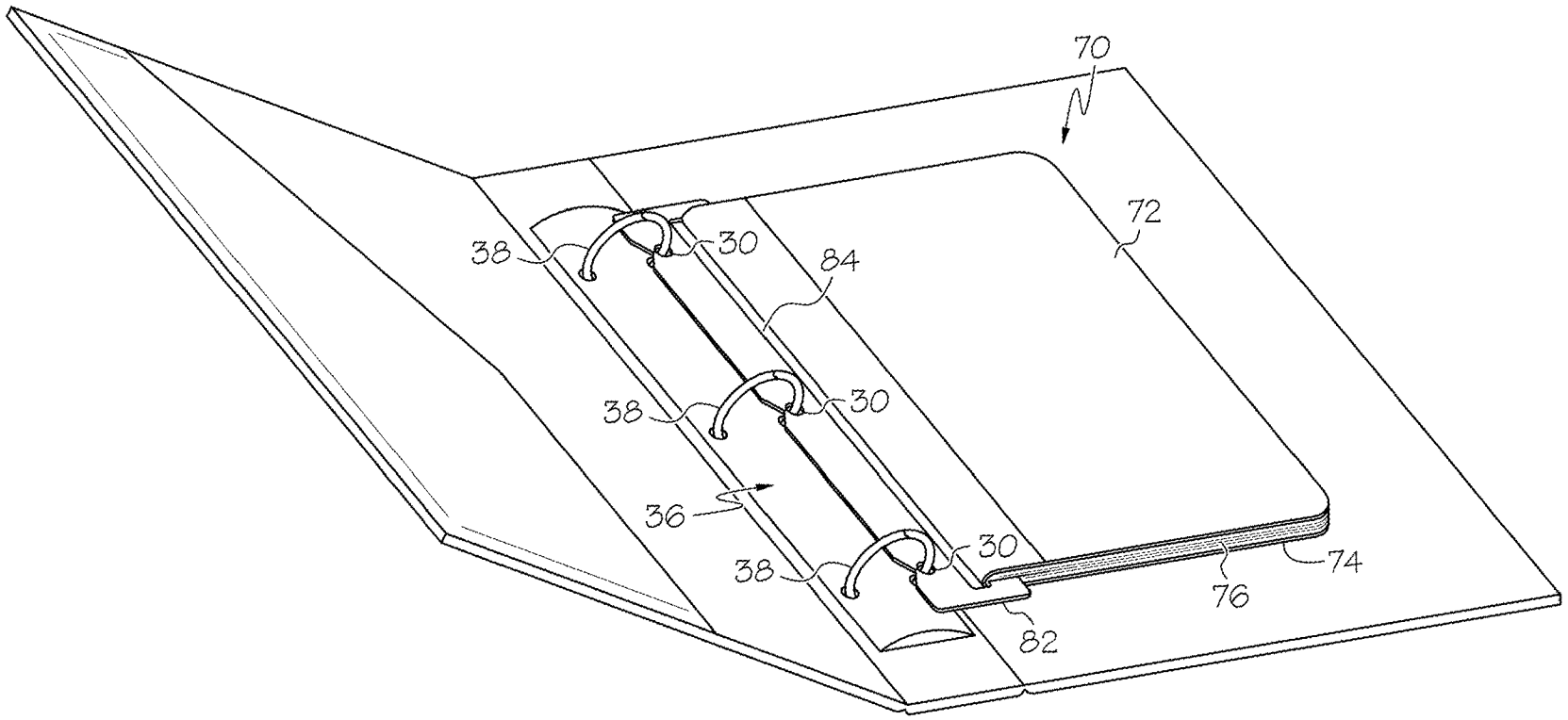
FIG. 17 illustrates the bound component of FIG. 16 bound to a binder via the coupling device.

FIGS. 15-17 illustrate another embodiment in which the bound device 70 can again take the form of a composition book or the like, and the coupling device 82 takes the form of a generally rectangular piece of material with a slit, cut-out or opening 84 formed therein. The coupling device 82 includes the flange 28 pairs as outlined above. The slit 84 of the coupling device 82 has a height generally corresponding to a height of a cover 72, 74 and/or pages 76 of the bound device 70. In this manner, the cover 72, 74 and/or pages 76 of the bound component 70 can be passed entirely through the slit 84 until the coupling device 82 is positioned adjacent to the spine/binding mechanism of the bound component 70, as shown in FIG. 16. The coupling device 82 can then be utilized to secure the bound device 70 to a binding mechanism 36, as shown in FIG. 17.

Figure 18:
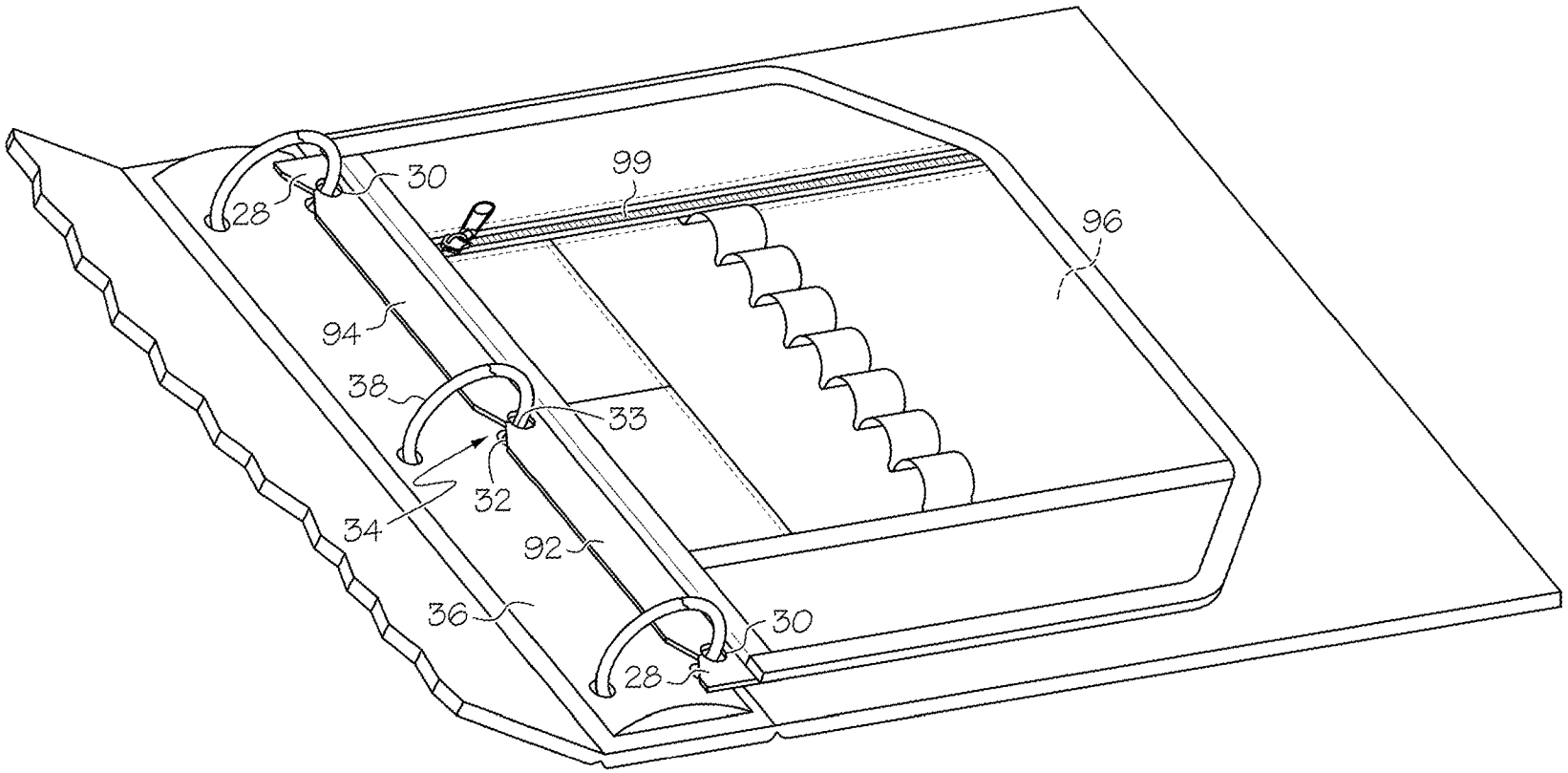
FIG. 18 is illustrates a pocket device with a coupling device, coupled to a binder.

FIG. 18 illustrates another embodiment in which a pocket device 90 includes a backing sheet of material 92 and three pairs of flanges 28 as outlined above. A flexible sheet of pocket material 94 is coupled to the backing sheet of material 92 to define a pocket cavity 96 therebetween, accessible via a closure fasteners 99, such as a zipper. The pocket device 90 can be secured to a binding mechanism 36, as shown in FIG. 18. In this embodiment the backing sheet of material 92 extends the entire "footprint" of the pocket device 90 to define the pocket cavity 96, provide structure/stiffness to the pocket device 90, and provide the flange 28 pairs.

Figure 19:
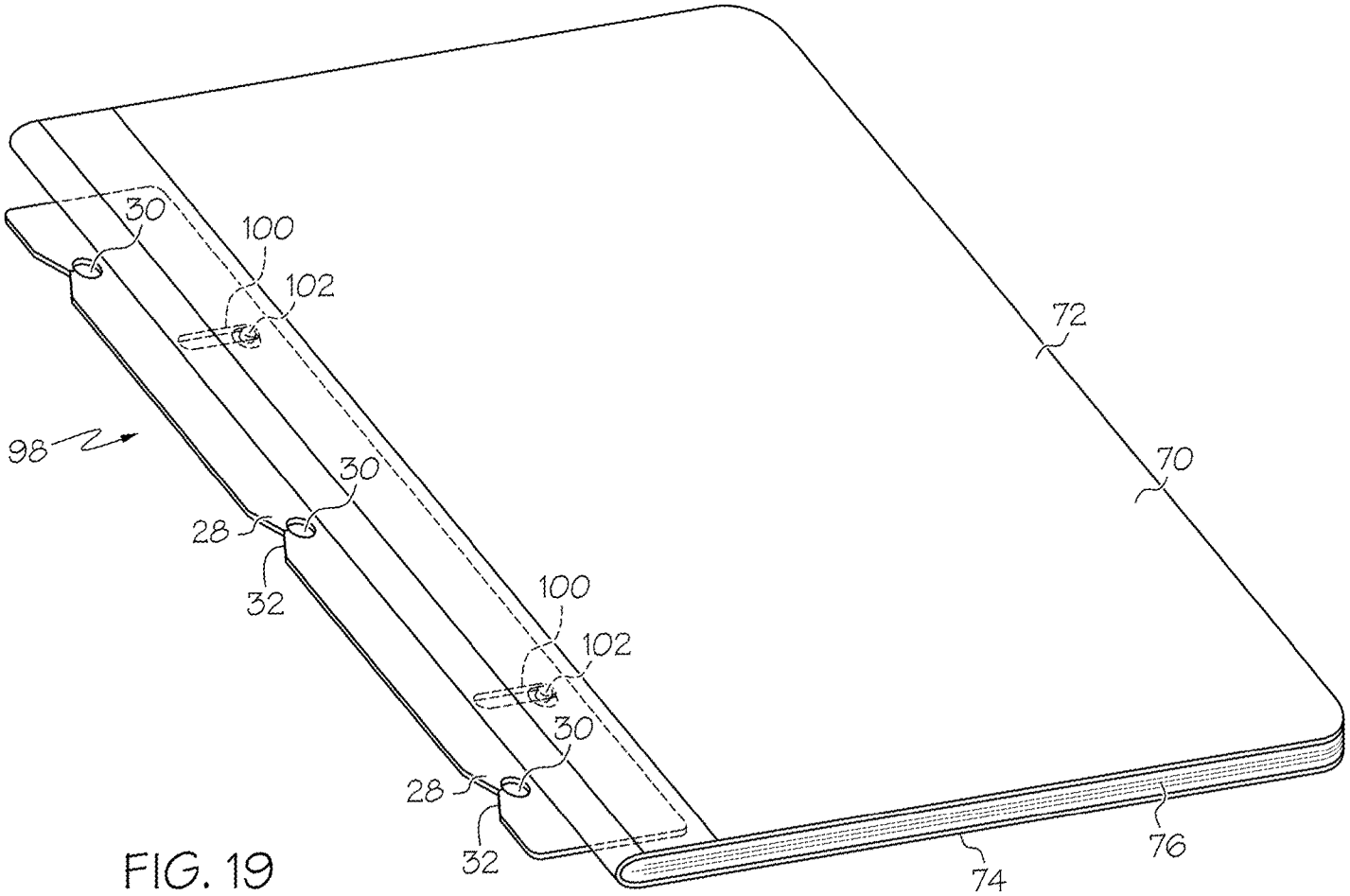
FIG. 19 is a top view of another bound component, with a coupling device in its extended position.
Figure 20:
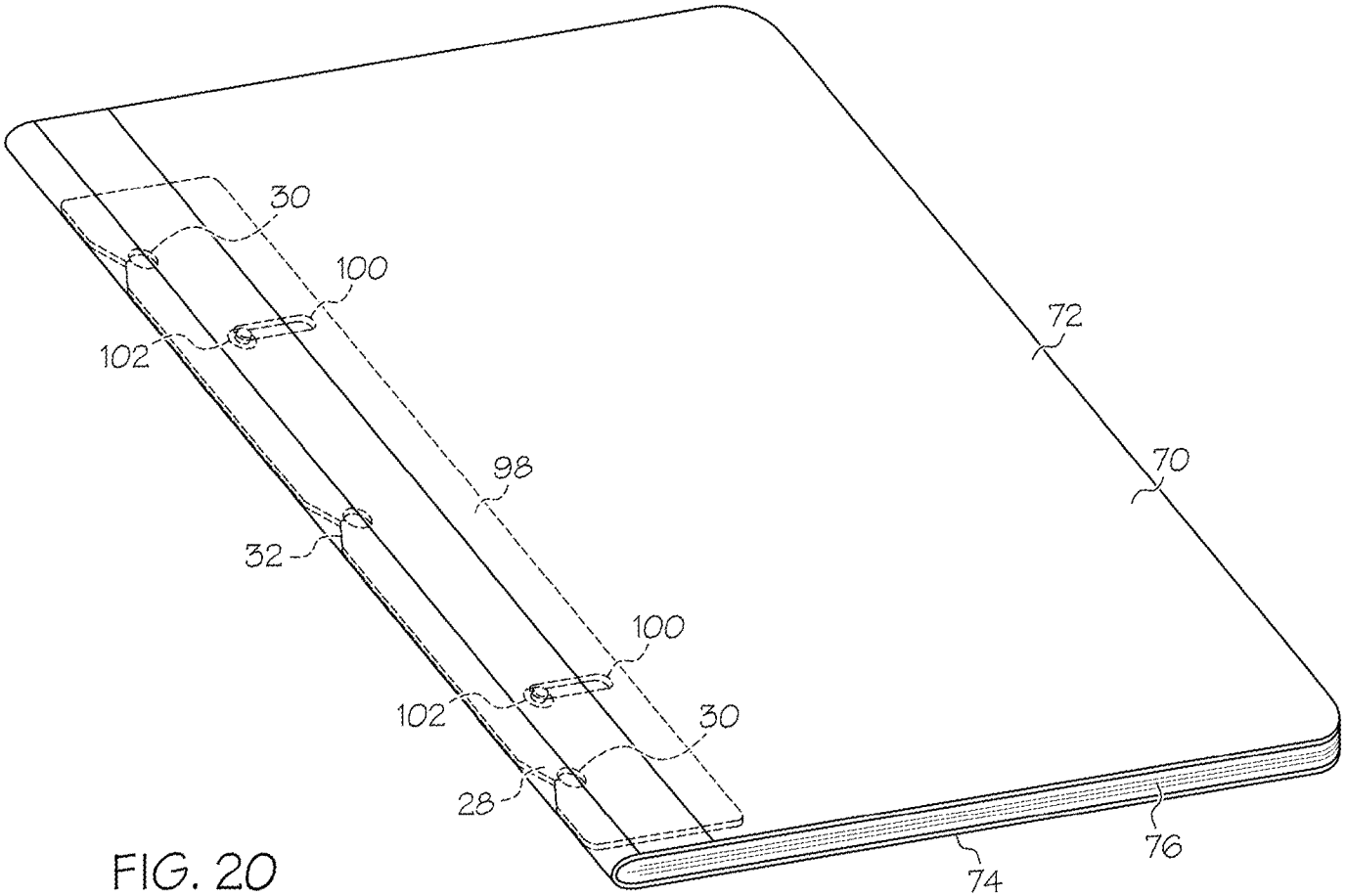
FIG. 20 is a top view of the bound component of FIG. 19 with the coupling device in its retracted position.
Figure 21:
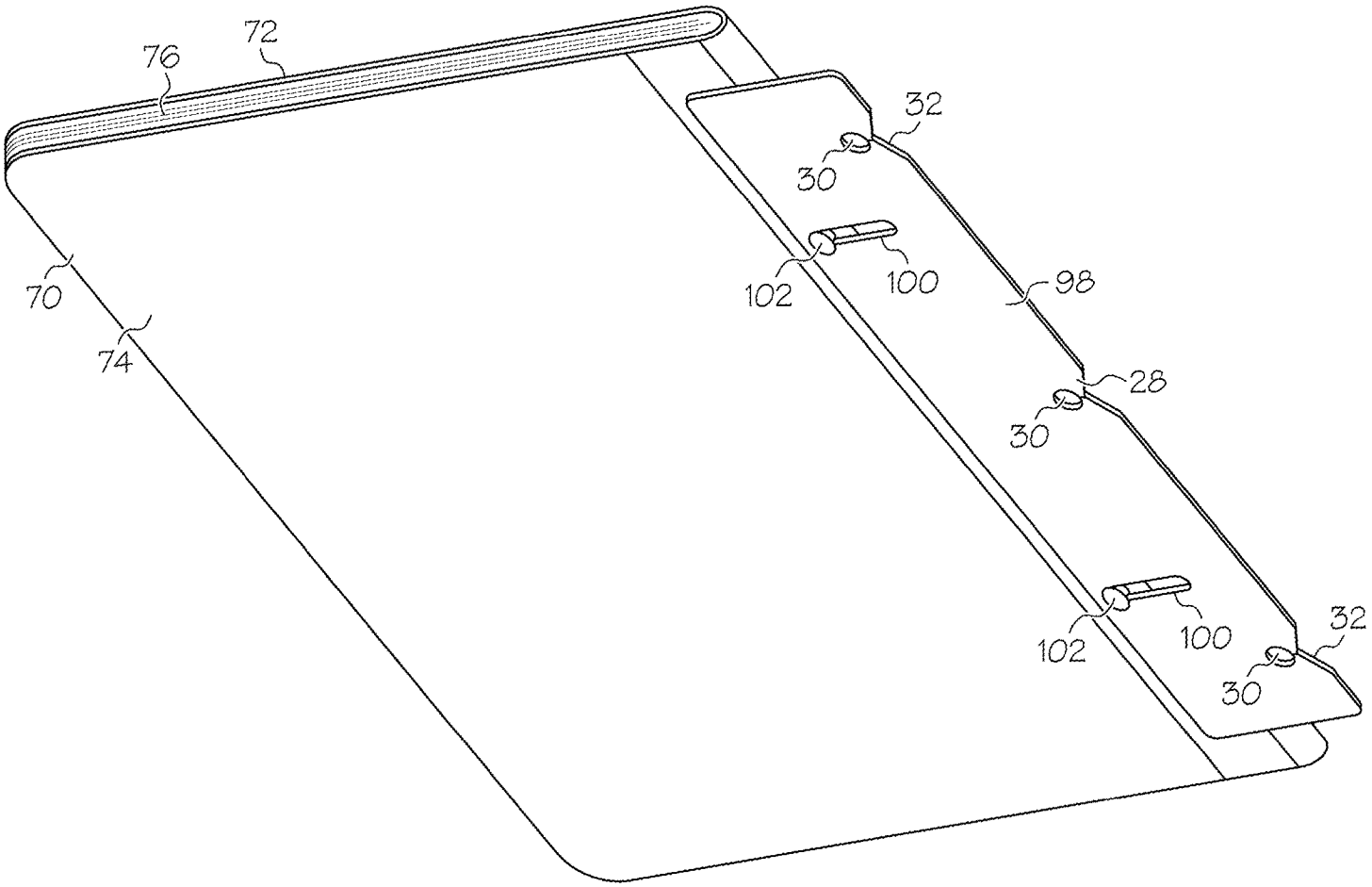
FIG. 21 is a back view of the bound component of FIG. 20.

FIGS. 19-21 illustrate another embodiment, wherein the coupling device 98 has a shape and configuration similar to certain embodiments described above. In this case, however, the coupling device 98 includes a pair of laterally-extending slots 100 formed therein. The coupling device 98 is secured to a cover 74 of a bound device 70 (or some other component, including but not limited to filers, notebooks, dividers, folders, composition books, portfolios, binders, pockets, or storage devices) by a pair of rivets or other connectors 102, each of which is slidably received in an associated slot 100 and secured to the cover 74. In this manner, the coupling device 98 is slidable in the lateral direction between an extended position, as shown in FIG. 19, wherein the flanges 28/openings 30 extend laterally beyond the bound device 70 and are accessible to bind the bound device 70 to a binding mechanism 36, to an retracted position, as shown in FIGS. 20 and 21, wherein the flanges 28/openings 30 are generally block/covered and do not extend laterally beyond the bound device 70, and the bound device 70 is more compact. Moreover, in this embodiment the openings 30 need not necessarily include the flanges 28, but could instead but fully enclosed openings 30 without any quick-attach feature, or could utilize a different type of quick-attach feature, etc.

Accordingly, as can be seen, the coupling device of the present invention can be utilized in various different configurations and in differing manners to enable an associated device to be quickly coupled to, and decoupled from, a binding mechanism, such as a three ring binder or the like. The coupling device can be relatively easy and inexpensive to manufacture and may require no or minimal modification of existing devices to accommodate use with the coupling device.

Having described the invention in detail and by reference to the various embodiments, it should be understood that modifications and variations thereof are possible without departing from the scope of the claims of the present application.

What is claimed is:

1. A system comprising:

a panel including a panel opening;

a supplemental panel coupled to said panel along a fold line, wherein said panel opening intersects said fold line; and a coupling device coupled to said panel, said coupling device including a coupling device opening, and a flange and a supplemental flange positioned adjacent to and on opposite sides of said coupling device opening, wherein at least part of said flange and said supplemental flange overlap with said panel opening, and wherein said flange and said supplemental flange are each elastically deflectable to allow a binding mechanism to pass said flange and into or out of said coupling device opening.

2. The system of claim 1 wherein said panel opening is positioned adjacent to said fold line.

3. The system of claim 1 wherein said supplemental panel includes a supplemental panel opening having an outer perimeter which is aligned with an outer perimeter of said panel opening.

4. The system of claim 3 wherein said panel opening and said supplemental panel opening intersect and are in communication with each other to together define a single larger opening.

5. The system of claim 1 wherein said panel and said supplemental panel are made of a single unitary piece of material, and wherein said coupling device is made of different piece of material.

6. The system of claim 1 wherein said panel and said supplemental panel form a body which is movable between a closed position wherein said panels are generally parallel, non-coplanar and facing each other, and an open position wherein said panels are generally parallel, coplanar and not facing each other, and wherein said panel opening and said coupling device opening at least partially overlap when said body is in said closed position.

7. The system of claim 1 wherein said panel and said supplemental panel each have about the same width extending in a direction perpendicular to said fold line.

8. The system of claim 1 wherein said the panel further includes a first and a second supplemental panel opening, and wherein said coupling device includes a first and a second supplemental coupling device opening, wherein the coupling device further includes a first and a second supplemental flange positioned adjacent to and at least partially overlapping with an associated supplemental coupling device opening and being elastically deflectable to allow a binding mechanism to pass thereby into or out the associated one of said supplemental coupling device openings, said panel openings and said coupling device openings being spaced apart along a length of said panel and configured to receive a three-ring binding mechanism therein.

9. The system of claim 1 wherein said flange has a surface that is configured to guide said binding mechanism toward said coupling device opening when said binding mechanism engages said flange, and wherein said coupling device is coupled to said panel such that said coupling device is and remains co-planar with said panel.

10. The system of claim 9 wherein said surface is an angled surface that is angled toward said coupling device opening.

11. The system of claim 1 wherein said flange has an inner surface that is configured to guide said binding mechanism out of said coupling device opening when said binding mechanism is retracted out of said coupling device opening.

12. The system of claim 1 wherein said panel includes an outer perimeter and said panel opening intersects or is immediately adjacent to said outer perimeter.

13. The system of claim 1 further comprising a binding mechanism at least partially received in said coupling device opening, and wherein said flange is configured to generally retain said binding mechanism in said coupling device opening and configured to be elastically deflected when said coupling device is removed from said coupling device opening.

14. The system of claim 1 further comprising a binding mechanism at least partially received in said coupling device opening, and wherein said coupling device includes a supplemental flange positioned adjacent to said flange and adjacent to said to coupling device opening, and wherein said binding mechanism has a thickness greater than a size of a gap, if any, between said flange and said supplemental flange such that at least one of said flange or said supplemental flange is configured to deflected when said binding mechanism is passed through said gap into or out of said coupling device opening.

15. The system of claim 1 wherein at least part of the coupling device extends into the panel opening.

16. The system of claim 1 wherein the panel opening is larger than the coupling device opening.

17. The system of claim 1 wherein the coupling device opening is not coextensive with the panel opening.

18. The system of claim 1 wherein said body and said coupling device are made of separate pieces of material.

19. The system of claim 1 wherein no portions of said panel overlap with said part of said flange that overlaps with the panel opening.

20. The system of claim 1 wherein at least part of said flange and said supplemental flange extend into said panel opening.

21. A system comprising:

a body including a first panel having a first panel opening and a second panel having a second panel opening and being directly pivotally coupled to said first panel along a fold line; and a coupling device positioned adjacent to said fold line, said coupling device including a coupling device opening and a pair of flanges positioned on opposite sides thereof, wherein at least one of said flanges is elastically deflectable away from the other one of said flanges to allow a binding mechanism to pass between said flanges and into or out of said coupling device opening, wherein at least one of said flanges overlaps with both said first panel opening and said second panel opening when said body is in a closed position.

22. The system of claim 21 wherein said body and said coupling device are made of a single, unitary piece of material, or wherein said body and said coupling device are made of separate pieces of material and wherein said coupling device is coupled to said panel such that said coupling device is and remains co-planar with said panel.

23. The system of claim 21 wherein at least one of said first panel opening or said second panel opening is aligned with said coupling device opening.

24. The system of claim 21 wherein both flanges of said pair of flanges overlaps with both said first panel opening and said second panel opening.

25. The system of claim 21 wherein said pair of flanges are co-planar.

26. The system of claim 21 wherein said pair of flanges have the same shape.

27. The system of claim 21 wherein said flanges are positioned on opposite sides of said coupling device opening.

28. A system comprising:

a body including a first panel and a second panel pivotally coupled about a pivot area, said body being movable to a closed position wherein said panels are generally parallel and facing each other, each panel including a panel opening positioned adjacent to said pivot area; and a coupling device coupled to said body and including a coupling device opening and a flange positioned adjacent to said coupling device opening, wherein said flange is elastically deflectable to allow a binding mechanism to pass said flange and into or out of said coupling device opening, wherein said panel opening of said first panel and said panel opening of said second panel are aligned when said body is in said closed position.

29. The system of claim 28 wherein each panel opening intersects said pivot area and wherein said coupling device is made of a single continuous piece of material that is a separate piece of material from said body.

30. The system of claim 28 wherein the panel opening of the first panel has an outer perimeter, and the panel opening of the second panel has an outer perimeter, and wherein the outer perimeters are entirely aligned when said body is in said closed position.

31. The system of claim 28 wherein said coupling device opening is generally aligned with said panel opening of said first panel and said panel opening of said second panel when said body is in said closed position.

32. A system comprising:

a body including a first panel having a first panel opening and a second panel having a second panel opening, wherein said first and second panels are pivotally coupled together; and a coupling device coupled to said body and including a coupling device opening and a flange positioned adjacent to said coupling device opening, wherein said flange overlaps both said first panel opening and said second panel opening when said body is in a closed position, and is elastically deflectable to allow a binding mechanism to pass said flange and into or out of said coupling device opening.

33. The system of claim 32 wherein said flange overlaps both said first panel opening and said second panel opening in a thickness direction extending perpendicular to a plane of said body when said body is in said closed position.

34. The system of claim 32 wherein first and second panels are pivotally coupled along a pivot area, and wherein said body is movable between said closed position wherein said first and second panels are generally parallel, non-coplanar and facing each other, and an open position wherein said first and second panels are generally parallel, coplanar and not facing each other.

* * * * *